United States Patent [19]

Inoue et al.

[11] Patent Number: 4,962,732

[45] Date of Patent: Oct. 16, 1990

[54] VALVE OPERATING DEVICE FOR INTERNAL COMBUSTION ENGINE

[75] Inventors: Kazuo Inoue, Tokyo; Masaaki Katoh, Saitama; Noriyuki Kishi, Tokyo, all of Japan

[73] Assignee: Honda Giken Kogyo Kabushiki Kaisha, Tokyo, Japan

[21] Appl. No.: 346,305

[22] Filed: May 2, 1989

Related U.S. Application Data

[63] Continuation of Ser. No. 218,549, Jul. 13, 1988, abandoned.

[30] Foreign Application Priority Data

Jul. 13, 1987 [JP] Japan ..... 62-174287

[51] Int. Cl.[5] ..... F01L 1/34

[52] U.S. Cl. ..... 123/90.16; 123/196 S; 123/198 D

[58] Field of Search ..... 123/90.15, 90.16, 90.55, 123/90.63, 90.46, 196 S, 198 D, 198 F, 90.4, 90.41

[56] References Cited

U.S. PATENT DOCUMENTS

| | | | |
|---|---|---|---|
| 2,829,540 | 4/1958 | Niemeyer | 74/569 |
| 3,299,869 | 1/1967 | Sicklesteel . | |
| 3,722,484 | 3/1973 | Gordini | 123/90.27 |
| 4,151,817 | 5/1979 | Mueller | 123/90.16 |
| 4,203,397 | 5/1980 | Soeters, Jr. | 123/90.16 |
| 4,206,734 | 6/1980 | Perr et al. | 123/123 AP |
| 4,448,156 | 5/1984 | Henault | 123/90.17 |
| 4,483,287 | 11/1984 | Monigold et al. | 123/196 S |
| 4,499,870 | 2/1985 | Aoyama | 123/90.16 |
| 4,523,550 | 6/1985 | Matsuura | 123/90.16 |
| 4,526,140 | 7/1985 | Monigold et al. | 123/196 S |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,567,861 | 2/1986 | Hara et al. | 123/90.16 |
| 4,576,128 | 3/1986 | Kenichi | 123/90.16 |
| 4,584,974 | 4/1986 | Aoyama et al. | 123/90.16 |
| 4,589,387 | 5/1986 | Miura et al. | 123/90.16 |
| 4,612,884 | 9/1986 | Ajiki et al. | 123/90.16 |
| 4,615,307 | 10/1986 | Kodama et al. | 123/90.16 |
| 4,648,364 | 3/1987 | Wills | 123/198 D |
| 4,656,977 | 4/1987 | Nagahiro et al. | 123/90.16 |
| 4,683,854 | 8/1987 | Goulet | 123/478 |
| 4,690,110 | 9/1987 | Nishimura et al. | 123/90.17 |
| 4,694,793 | 9/1987 | Kawakita et al. | 123/196 S |
| 4,727,831 | 3/1988 | Nagahiro et al. | 123/90.16 |
| 4,741,306 | 5/1988 | Watanabe et al. | 123/198 DB |
| 4,788,946 | 12/1988 | Inoue et al. | 123/90.16 |
| 4,790,274 | 12/1988 | Inoue et al. | 123/90.44 |

FOREIGN PATENT DOCUMENTS

| | | |
|---|---|---|
| 0186341 | 3/1985 | European Pat. Off. . |
| 0213758 | 11/1987 | European Pat. Off. . |
| 3613945 | 4/1986 | Fed. Rep. of Germany . |
| 1003568 | 11/1951 | France . |
| 61-19911 | 6/1986 | Japan . |
| 61-81510 | 8/1986 | Japan . |
| 511903 | 12/1938 | United Kingdom . |
| 1399813 | 10/1971 | United Kingdom . |
| 2054036 | 7/1979 | United Kingdom . |
| 2066361 | 1/1980 | United Kingdom . |
| 2141172 | 12/1984 | United Kingdom . |
| 2159877 | 12/1985 | United Kingdom . |
| 2185784 | 7/1987 | United Kingdom . |

*Primary Examiner*—Charles J. Myhre
*Assistant Examiner*—Weilun Lo
*Attorney, Agent, or Firm*—Lyon & Lyon

[57] ABSTRACT

A valve operation mode changing system for the intake or exhaust valves of an internal combustion engine is controlled in response to engine speed and temperature of the working oil utilized in the system in such a way as to permit the valve operating mode to be changed from a low-speed to a high-speed mode in response to engine speed requirements only when the temperature of the working oil exceeds a predetermined value. The system also provides for terminating fuel supply to the engine when the temperature of the working oil is below a predetermined temperature and the speed of the engine exceeds a predetermined temperature.

14 Claims, 4 Drawing Sheets

VALVE OPERATING DEVICE FOR INTERNAL COMBUSTION ENGINE

This application is a continuation of application Ser. No. 218,549, filed July 13, 1988, now abandoned.

BACKGROUND OF THE INVENTION

The present invention relates to a valve operating device for internal combustion engines, and particularly to a valve operating device having a hydraulic valve operation mode changing mechanism for changing the operation mode in which an intake valve or an exhaust valve is opened and closed between a low-speed mode, corresponding to low-speed operation of the engine, and a high-speed mode, corresponding to high-speed operation of the engine, and control means for controlling operation of the valve operation mode changing mechanism according to the rotational speed of the engine.

Valve operating devices of the type described above are known, one example being disclosed in Japanese Laid-Open Publication No. 61-19911. With such conventional arrangements, operation of the valve operation mode changing mechanism is controlled by controlling hydraulic pressure according to the rotational speed of the engine. When the viscosity of working oil is high, as at low temperatures, however, the valve operation mode changing mechanism of such arrangements cannot operate quickly to vary the hydraulic pressure for changing the operation mode of the intake or exhaust valve from the low-speed mode to the high-speed mode. Under this condition, regardless of a high-speed operation of the engine, the intake or exhaust valves may remain in the low-speed mode. When this occurs, mechanical problems, such as, for example, a jump of the intake or exhaust valve may occur due to the resiliency of the spring of a lost-motion mechanism. Moreover, where the valve operating device is incorporated in an engine having an electronic fuel injection device of the intake vacuum/engine speed type and a spark advancer, the air-fuel mixture may become too rich, or the ignition spark may be retarded excessively.

SUMMARY OF THE INVENTION

The present invention has been made in view of the aforesaid drawbacks of the prior art, and it, accordingly, is an object of the invention to provide a valve operating device for an internal combustion engine that is capable of avoiding operation failures of a valve operation mode changing mechanism when the temperature of the working oil is excessively low.

According to the invention, the control means is connected to a temperature detector for detecting the temperature corresponding to the temperature of oil in the valve operation mode changing mechanism and to a speed detector for detecting the rotational speed of the engine. The control means is arranged such that, when the temperature detected by the temperature detector exceeds a predetermined temperature, the control means operates the valve operation mode changing mechanism to shift the intake or exhaust valve from the low-speed mode to the high-speed mode in response to a rotational speed detected by the speed detector in excess of a first predetermined value. When, on the other hand, the temperature detected by the temperature detector is equal to, or lower than, such predetermined temperature, the control means controls operation of the valve operation mode changing mechanism to hold the intake or exhaust valve in the low-speed mode and, when a rotational speed in excess of a second predetermined value is detected by the speed detector, the control means issues a signal to stop the supply of fuel to the engine.

With the above arrangement, when the engine is operating at a low temperature at which the viscosity of working oil is excessively high, the valve operation mode changing mechanism is kept in the low speed mode to prevent itself from being subjected to operational failures due to the high viscosity of the working oil. Also, under such condition, when there is a demand to increase engine speed out of the low-speed mode, the supply of fuel to the engine is terminated to protect the engine from trouble.

For a better understanding of the invention, its operating advantages and the specific objectives obtained by its use, reference should be made to the accompanying drawings and description which relate to a preferred embodiment thereof.

DETAILED DESCRIPTION OF A PREFERRED EMBODIMENT

Figure 1:
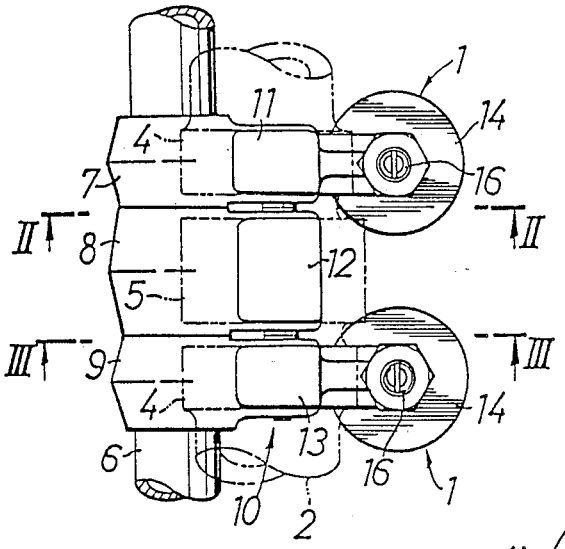
FIG. 1 is a partial plan view of an engine valve arrangement incorporating the present invention.
Figure 2:
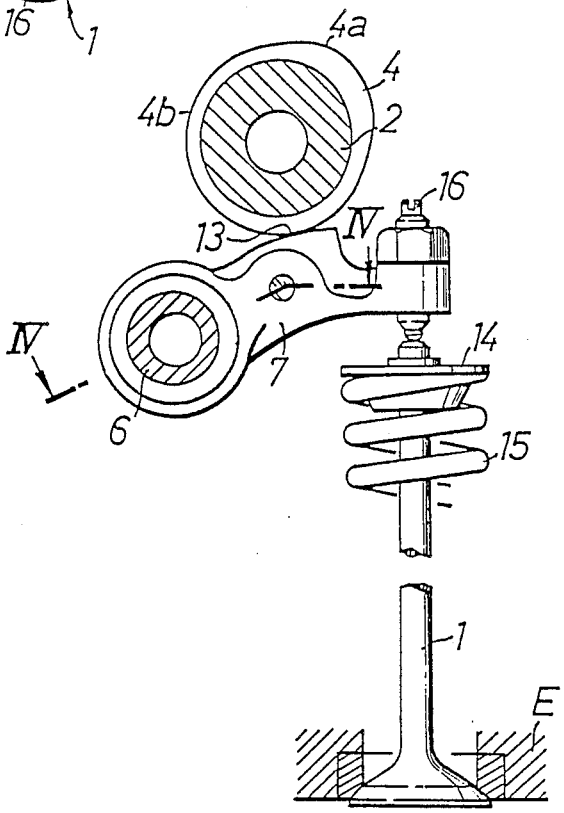
FIG. 2 is a cross-sectional view taken along line II—II of FIG. 1.
Figure 3:
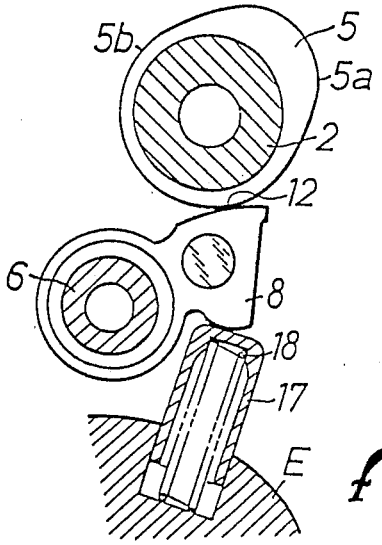
FIG. 3 is a cross-sectional view taken along line III—III of FIG. 1.

FIGS. 1, 2 and 3 illustrate a pair of intake valves 1 disposed in an engine body E and arranged to be opened and closed by a pair of low-speed cams 4 and a high-speed cam 5. The cams 4 and 5 are integrally formed on a camshaft 2 which is rotatable by the crankshaft of the engine at a speed ratio of 1/2 with respect to the speed of rotation of the engine. Operation of the valves is effected by first, second and third rocker arms 7, 8, 9 that are angularly movably supported on a rocker shaft 6 extending parallel to the camshaft 2, and by a valve operation mode changing mechanism 10 for selectively connecting and disconnecting the rocker arms 7, 8, 9 to change the operation mode of the intake valves 1 according to the operating conditions of the engine.

The camshaft 2 is rotatably disposed above the engine body E. The low-seed cams 4 are disposed on the camshaft 2 in alignment with the respective intake valves 1. The high-speed cam 5 is disposed on the camshaft 2 between the low-speed cams 4. Each of the low-speed cams 4 has a cam lobe **4*a* projecting radially outwardly to a relatively small extent and a base circle portion 4*b*. The high-speed cam 5 has a cam lobe 5*a* projecting radially outwardly to a relatively large extent and a base circle portion 5*b***.

The rocker shaft 6 is fixed below the camshaft 2. The first and third rocker arms 7, 9 are basically of the same configuration and are disposed on the rocker shaft 6 in alignment with the respective intake valves 1, extending to a position above the valves. The first and third rocker arms 7, 9 have on their respective upper surfaces cam slippers 11, 13 that are arranged to be held in slidable contact with the respective low-speed cams 4. The second rocker arm 8 is disposed on the rocker shaft 6 between the first and third rocker arms 7, 9 and has on its upper surface a cam slipper 12 that is arranged to be held in slidable contact with the high-speed cam 5.

Flanges 14 are attached to the upper ends of the respective intake valves 1 and the intake valves are normally urged in a closing direction, i.e., upwardly, by valve springs 15 disposed between the flanges 14 and the engine body E. Tappet screws 16 are adjustably threaded through the first and third rocker arms 7, 9 so as to be engageable with the upper ends of the intake valves 1.

A bottomed cylindrical lifter 17 is held against the lower surface of the end of the second rocker arm 8 and is normally urged upwardly by a lifter spring 18 interposed between the lifter 17 and the engine body E to hold the cam slipper 12 of the second rocker arm 8 slidably against the high-speed cam 5 at all times.

Figure 4:
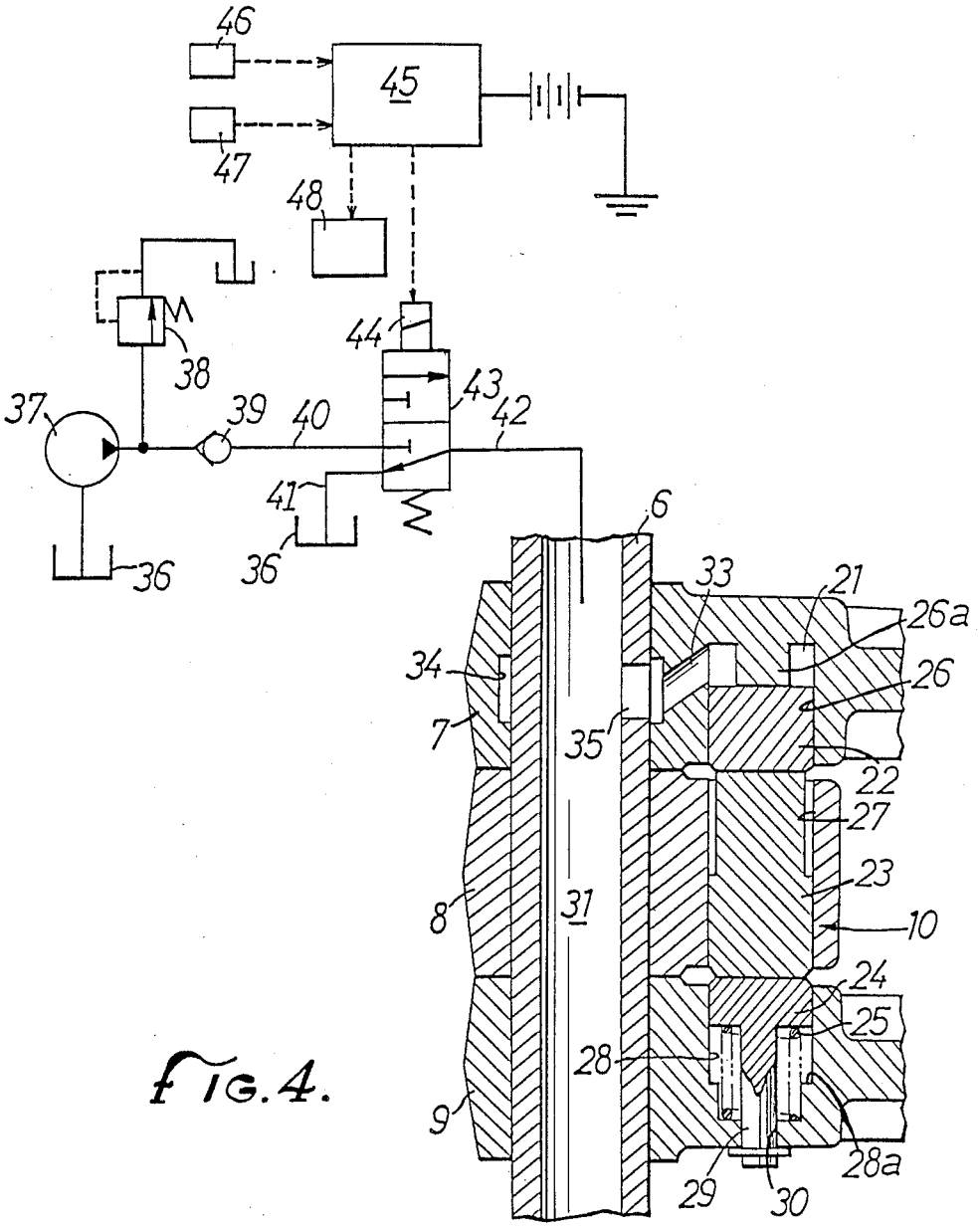
FIG. 4 is a cross-sectional view taken along line IV—IV of FIG. 1 and further presenting a schematic representation of the hydraulic pressure system and control means of the present invention.

As shown in FIG. 4, the valve operation mode changing mechanism 10 comprises first coupling pin 22 that is slidably fitted in the first rocker arm 7 and that has one end facing into a hydraulic pressure chamber 21. The first coupling pin 22 is arranged to be movable between a position in which it interconnects the first and second rocker arms 7, 8 and a position in which it disconnects the first and second rocker arms 7, 8 from each other. Also included is a second coupling pin 23 that is slidably fitted in the second rocker arm 8. The pin 23 has one end held coaxially against the said other end of the first coupling pin 22 with the second coupling pin 23 being movable between a position in which it interconnects the second and third rocker arms 8, 9 and a position in which it disconnects the second and third rocker arms 8, 9 from each other. A stopper pin 24 slidably fitted in the third rocker arm 9 has one end held coaxially with the said other end of the second coupling pin 23. A return spring 25, disposed under compression between the stopper pin 24 and the third rocker arm 9, operates to normally urge the pins 22, 23, 24 to disconnect the rocker arms from each other.

The first rocker arm 7 has defined therein a first bottomed hole 26 parallel to the rocker shaft 6 and opening toward the second rocker arm 8. The first coupling pin 22 is slidably fitted in the first hole 26 with the hydraulic chamber 21 being defined between the said one end of the first coupling pin 22 and the closed end of the first hole 26. The closed end of the first hole 26 has a limiting projection **26*a* for abutting against the end of the first coupling pin 22. The first coupling pin 22 has an axial length selected such that, when the said one end thereof abuts against the limiting projection 26*a*, the other end of the first coupling pin 22 is positioned between the first and second rocker arms 7, 8**.

The second rocker arm 8 has a guide hole 27 defined therein extending between its opposite sides parallel to the rocker shaft 6. The guide hole 27 has the same diameter as the first hole 26. The second coupling pin 23 is slidably fitted in the guide hole 27 and has an axial length selected such that, when its end abutting against the other end of the first coupling pin 22 is disposed between the first and second rocker arms 7, 8, its other end is positioned between the second and third rocker arms 8, 9.

The third rocker arm 9 has a second bottomed hole 28 defined therein parallel to the rocker shaft 6 and opening toward the second rocker arm 8. The second hole 28 is the same diameter as the guide hole 27. The stopper pin 24 is slidably fitted in the second hole 28 with one end abutting against the said other end of the second coupling pin 23. The second hole 28 has a step **28*a* at an intermediate position on its peripheral surface that faces toward the second rocker arm 8 for receiving the other end of the stopper pin 24. When the other end of the stopper pin 24 engages the step 24*a*, the said one end of the stopper pin 24 is positioned within the second hole 28**.

The stopper pin 24 is provided with a coaxial guide rod 29 that is arranged to be movably inserted through a guide hole 30 defined in the closed end of the second hole 28. The return spring 25 is disposed around the guide rod 29 and is interposed between the stopper pin 24 and the closed end of the second hole 28.

The first hole 26, the guide hole 27, and the second hole 28 are arranged such that they are coaxially aligned with each other when the rocker arms 7, 8, 9 are slidingly held against the base circle portions **4*b*, 5*b*, 4*b* of the cams 4, 5, 4**, respectively.

The rocker shaft 6 has a hydraulic pressure supply passage 31 extending axially therethrough. The first rocker arm 7 contains an oil passage 33 communicating with the hydraulic pressure chamber 21 and an annular groove 34 communicating with the hydraulic passage 33 and surrounding the rocker shaft 6. The rocker shaft 6 also has an oil hole 35 through which the hydraulic pressure supply passage 31 communicates with the annular groove 34. Therefore, the hydraulic pressure supply passage 31 is held in communication with the hydraulic pressure chamber 21 at all times.

In the hydraulic system supplying oil to the passage 31 an oil supply passage 40 is connected to the outlet port of a hydraulic pressure pump 37 which extracts working oil from an oil tank 36 and has a relief valve 38 and a check valve 39 that are successively positioned downstream from the pump 37. An oil release passage 41 is connected to the oil tank 36. The hydraulic pressure supply passage 31 is connected to an oil passage 42. Between the oil supply passage 40, the oil release passage 41, and the oil passage 42, there is disposed a directional control valve 43 for switching between a high-speed position in which the oil supply passage 40 communicates with the oil passage 42 and a low-speed position in which the oil passage 42 communicates with the oil release passage 41. The directional control valve 43 is shiftable in response to energization and deenergization of a solenoid 44. When the solenoid 44 is deenergized, the oil passage 42 communicates with the oil release passage 41, as shown in FIG. 4. In response to energization of the solenoid 44, the directional control valve 43 communicates the oil passage 42 with the oil supply passage 40.

The solenoid 44 is controlled by a control unit 45, such as a computer, or the like. To the control unit 45 there are electrically connected a temperature detector 46 and a speed detector 47. The temperature detector 46 is preferably arranged for detecting the temperature of a coolant of the engine which corresponds to the temperature of the working oil, and the speed detector 47 is arranged for detecting the rotational speed of the engine. Dependent on the signals emitted by the detectors 46, 47, the control unit 45 selectively energizes and de-energizes the solenoid 44 and also controls a fuel supply unit 48 for supplying fuel to the engine.

Figure 5:
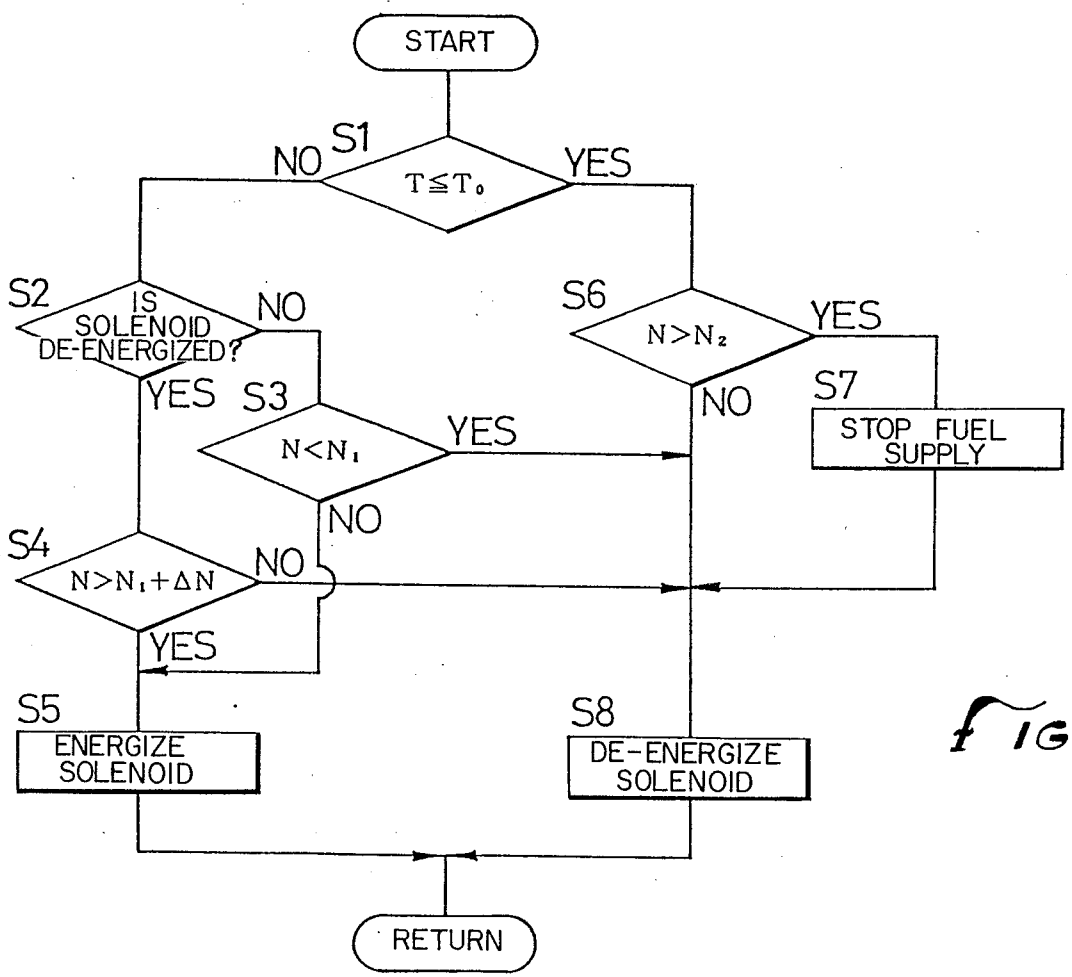
FIG. 5 is a flow diagram of the control sequence exercised by the control means of FIG. 4.

The control unit 45 is programmed to execute a control sequence as shown in FIG. 5. A step S1 determines whether or not the temperature T detected by the temperature detector 46 is equal to, or lower than, a predetermined temperature $T_0$, such as 50° C. If T is greater than $T_0$, the control proceeds to step S2 which determines whether the solenoid 44 is de-energized or not, i.e., if the oil passage 42 communicating with the hydraulic pressure chamber 21 of the valve operation mode changing mechanism 10 communicates with the oil release passage 41 to release the hydraulic pressure from the hydraulic pressure chamber 21, or not.

If the solenoid 44 is energized, i.e., if hydraulic pressure is supplied to the hydraulic pressure chamber 21 in step S2, the control proceeds to step S3 which determines whether the engine speed N detected by the speed detector 47 is smaller than a first preset value $N_1$, e.g., from about 4,000 to about 4,500 rpm, or not. If N is equal to, or greater than $N_1$, the control proceeds to step S5 in which the solenoid 44 is energized. If, however, N is less than $N_1$, then the control proceeds to step S8 in which the solenoid 44 is de-energized. If the solenoid 44 is deenergized in step S2, the control proceeds to a step S4 which determines if N is greater than a value, $(N_1+\Delta N)$. $\Delta N$ is a value that is taken into account in view of engine speed hunting. If N is greater than the value, $(N_1+\Delta N)$, the solenoid 44 is deenergized, however, in step S8. When conditions are such that the solenoid 44 is to be de-energized, the engine speed N is determined by the first preset value $N_1$. When conditions permit the solenoid 44 to be energized, the engine speed N is determined by the first preset value $N_1$ plus $\Delta N$.

If T is equal to, or less than, $T_0$ in step S1, the control proceeds to step S6 to determine whether or not the speed N is higher than a second preset value $N_2$, e.g., 6,000 rpm. The second preset value $N_2$ is greater than the first preset value $N_1$ and smaller than a third preset value, e.g., a value in the range of from 7,000 to 8,000 rpm that limits the normal maximum engine speed. If N is greater than $N_2$, a signal to terminate the supply of fuel is applied to the fuel supply unit 48 in step S7. If N is equal to or less than $N_2$, the solenoid 44 is de-energized in step S8.

The operation of the valve operating device according to the invention is as follows. When the solenoid 44 is de-energized by the control unit 45, the oil passage 42 communicates with the release passage 41 to release hydraulic pressure from the hydraulic pressure chamber 21. Therefore, the mutually abutting surfaces of the first and second coupling pins 22, 23 are positioned between the first and second rocker arms 7, 8, and the mutually abutting surfaces of the second coupling pin 23 and the stopper pin 24 are positioned between the second and third rocker arms 8, 9, so that the rocker arms 7 through 9 are not connected to each other. Consequently, the intake valves 1 are opened and closed by the first and second rocker arms 7, 9 which are angularly moved by the low-speed cams 4, at the timing and lifting according to the profile of the low-speed cams.

Figure 6:
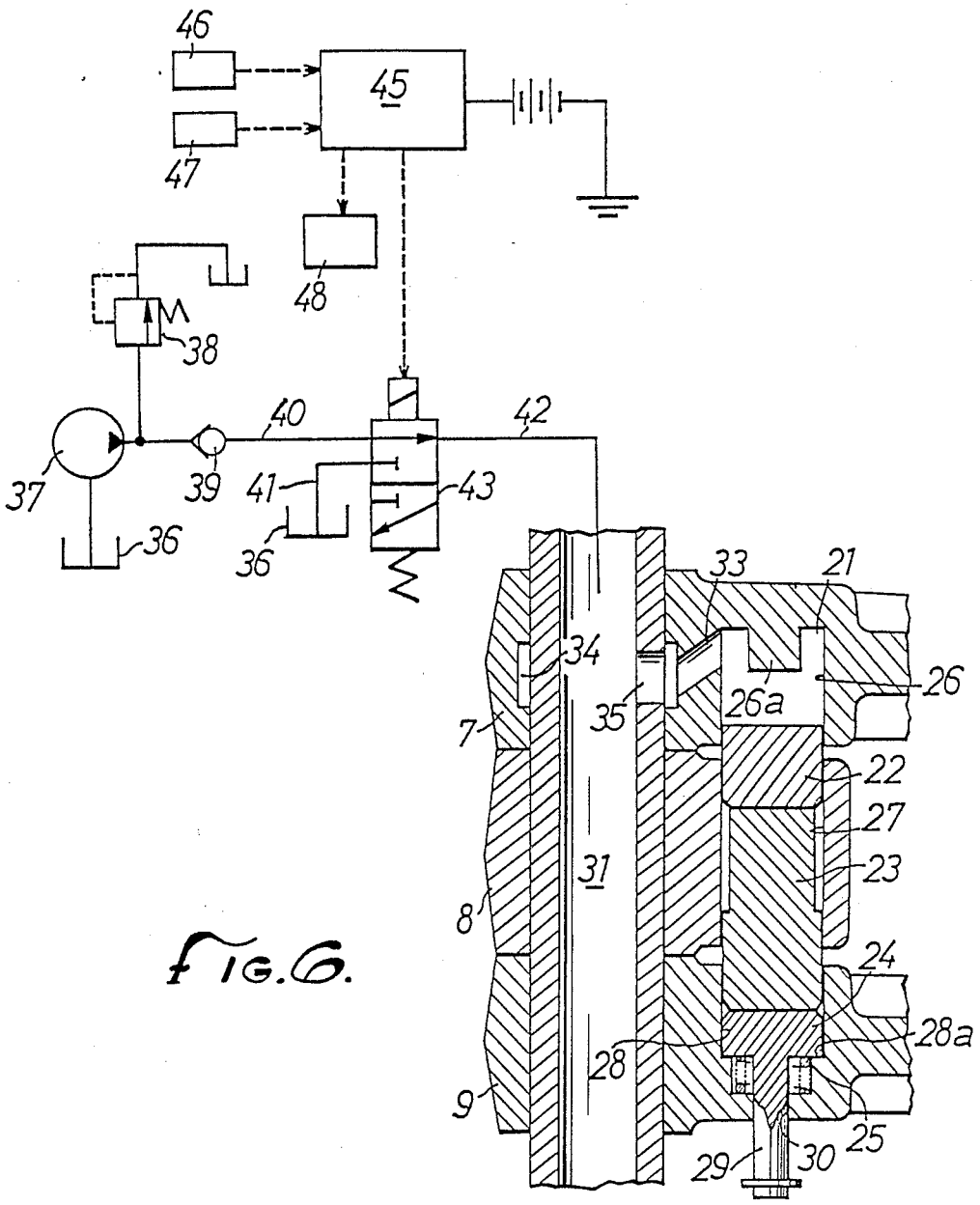
FIG. 6 is a view similar to FIG. 4 illustrating the system organization when the valve operating rocker arms are interconnected.

When the solenoid 44 is energized by the control unit 45, the directional control valve 43 is shifted, as shown in FIG. 6, to bring the oil supply passage 40 into communication with the oil passage 42, thereby to supply hydraulic pressure to the hydraulic pressure chamber 21. Consequently, the first coupling pin 22, the second coupling pin 23, and the stopper pin 24 are displaced against the resiliency of the return spring 25 until the first coupling pin 22 is fitted into the guide hole 27 and the second coupling pin 23 is fitted into the second hole 28. Therefore, the rocker arms 7, 8, 9 are coupled to each other. Since the first and third rocker arms 7, 9 are caused to swing with the second rocker arm 8, which is angularly moved by the high-speed cam 5, the intake valves 1 are thereby opened and closed at the timing and lift according to the profile of the high-speed cam 5.

When the internal combustion engine is caused to operate at a low temperature at which the viscosity of the working oil is excessively high, i.e, when the temperature detected by the temperature detector 46 is equal to or lower than a preset temperature, the solenoid 44 is prevented from being energized. Therefore, the valve operation mode changing mechanism 10 is also prevented from operating and, concomitantly, from experiencing an operation failure which would otherwise be caused by the high viscosity of the working oil. Moreover, the supply of fuel is stopped when a rotational speed of the engine exceeding the second preset value $N_2$, e.g., 6,000 rpm is detected. Consequently, the described arrangement prevents the various conventional problems, such as a jump of the intake valves 1 due to an excessive increase in the engine speed while the intake valves 1 are in the low-speed operation mode, or an excessively rich air-fuel mixture, or an excessively retarded ignition spark where the valve operating device is incorporated in an engine having an electronic fuel injection device of the intake vacuum-/engine speed type and a spark advancer.

Other signals, such as a signal indicating intake pipe vacuum, or a signal indicating a throttle valve opening, or a clutch signal, and the like, may also be applied to the control unit for controlling operation of the valves.

With the arrangement of the present invention, as described above, the control unit is connected to a temperature detector for detecting the temperature corresponding to the temperature of the working oil in the valve operation mode changing mechanism and a speed detector for detecting the rotational speed of the engine. When the temperature detected by the temperature detector exceeds a predetermined value, the control unit operates to permit the valve operation mode changing mechanism to shift the intake or exhaust valves from the low-speed mode to the high-speed mode in response to a speed detected by the speed detector in excess of a first preset speed value. When the temperature detected by the temperature detector is equal to, or lower than, the aforementioned predetermined value, the control unit controls operation of the valve operation mode changing mechanism to hold the intake or exhaust valves in the low-speed mode and, in response to a speed detected by the speed detector in excess of a second preset value, the control unit issues a signal to terminate the supply of fuel to the engine. Therefore, the valve operating device for the present invention is effective to prevent the valve operation mode changing mechanism from being subjected to an operation failure caused by an increase in the viscosity of the working oil. The described valve operating device is also effective to prevent the engine speed from increasing excessively while the valves are held in the low-speed mode by terminating the supply of fuel to the engine, thus protecting the engine from trouble.

While the present invention has been particularly described as being applied to intake valves, it should be understood that the invention is also applicable to a valve operating device for exhaust valves. It should be further understood that, although a preferred embodiment of the invention has been illustrated and described herein, changes and modifications can be made in the described arrangement without departing from the scope of the appended claims.

We claim:

1. A method for controlling the operating of an internal combustion engine having a cylinder and fuel supply and intake and exhaust valves operatively associated with said cylinder and a hydraulically-operated valve operation mode changing mechanism to vary the mode of operation of such valves between low speed engine conditions and high speed engine conditions, comprising the steps of:

monitoring the speed of said engine;

monitoring the temperature of the working oil utilized in said valve operating mode changing mechanism;

preventing the valve operating mode changing device to shift the operation of said valves from a low-speed mode to a high-speed mode in response to the detection of a first engine speed when a working oil temperature equal to or less than a predetermined value is also detected; and terminating the supply of fuel to said engine in response to the detection of a second predetermined value of engine speed when a working oil temperature equal to or less than said predetermined value continues to be detected.

2. A method for controlling the operation of an internal combustion engine having a cylinder and a fuel supply and intake and exhaust valves operatively associated with said cylinder and a hydraulically-operated valve operation mode changing mechanism to vary the mode of operation of such valves between low speed engine conditions and high speed engine conditions, comprising the steps of:

monitoring the speed of said engine;

monitoring the temperature of the working oil utilized in said valve operating mode changing mechanism;

preventing the valve operating mode changing device to shift the operation of said valves from a low-speed mode to a high-speed mode in response to the detection of a first predetermined engine speed when a working oil temperature equal to or less than a predetermined value is also detected, but permitting the valve operation mode changing device to shift the operation of said valves from a low-speed mode to a high-speed mode in response to the detection of said first predetermined engine speed and the detection of a working oil having a temperature value greater than said predetermined value; and terminating the supply of fuel to said engine in response to the detection of a second predetermined value of engine speed when a working oil temperature equal to or less than said predetermined value continues to be detected.

3. The method according to any of claim 1 or 2 comprising the step of monitoring the temperature of working oil in the valve operating mode changing mechanism by monitoring the temperature of a fluid utilized to cool the engine.

4. The method according to claim 3 including the step of monitoring engine speed by sensing the rotational velocity of the engine.

5. The method according to claim 1 including the steps of:

admitting working fluid to said mechanism to shift the operation of said valves from a low-speed mode to a high-speed mode in response to the detection of a first predetermined engine speed and of a working oil temperature greater than said predetermined value; and releasing working fluid from said mechanism to maintain the operation of said valves in said low-speed mode when either a working oil temperature equal to or less than said predetermined value or an engine speed equal to or less than said first predetermined value is detected.

6. The method according to claim 5 in which said second predetermined value of engine speed is greater than said first predetermined value thereof.

7. A valve operation system for an internal combustion engine having a cylinder and fuel supply means and intake and exhaust valves operatively associated with said cylinder and a valve operation mode changing mechanism for operating intake or exhaust valves in a low-speed mode or a high-speed mode dependent on the pressure level of working oil applied to said mechanism, a control valve operatively disposed between said mechanism and a source of working oil for varying the level of hydraulic pressure supplied to said mechanism, and control means for controlling the operating of said control valve, said system comprising:

a temperature detector for monitoring the temperature of said working oil in said mode changing mechanism and for imparting to said control means a signal commensurate with the detected temperature;

an engine speed detector for monitoring the speed of said engine and for imparting to said control means a signal commensurate with the detected engine speed;

said control means including means for operating said control valve to impart to said mode changing mechanism a working oil pressure effective to change said intake or exhaust valve operating mode from a low-speed mode only when the temperature detected by said temperature detector is equal to or exceeds a predetermined value, and means for terminating the supply of fuel to said engine when the temperature detected by said temperature detector is less than said predetermined value and the speed detected by said engine speed detector exceeds a second predetermined value.

8. The valve operating system according to claim 7 in which said second predetermined value of engine speed is greater than said first predetermined value thereof.

9. The valve operating system according to claim 8 in which said temperature detector is operatively arranged to detect the temperature of engine coolant.

10. The valve operating system according to claim 7 in which said control valve is a direction valve operative in one position to communicate said mode changing mechanism with said working oil source and in another position to communicate said mode changing value with an oil release passage; and an electrical operator actuated by said control means to dispose said control valve in one of said two positions.

11. The valve operating system according to claim 7 in which said mode changing mechanism is effective to operate said intake or exhaust valves in said low-speed mode when connected to said release passage and in said high-speed mode when connected to said working oil source.

12. The valve operating system according to claim 11 wherein said fuel supply means is controlled by said control means and said control means includes means for operating said fuel supply means to terminate the supply of fuel to said engine when the temperature detected by said temperature detector is less than said predetermined value and the speed detected by said engine speed detector is equal to or exceeds said second predetermined value.

13. A method for controlling the operation of an internal combustion engine having a cylinder and fuel supply and intake and exhaust valves operatively associated with said cylinder and a hydraulically-operated valve operation mode changing mechanism to vary the mode of operation of such valves between low speed engine conditions and high speed engine conditions, comprising the steps of:

monitoring the speed of said engine;

monitoring the temperature of engine oil utilized in said valve operating mode changing mechanism by measuring the temperature of a fluid utilized to cool said engine; and preventing the valve operating mode changing device to shift the operation of said valves from a low-speed mode to a high-speed mode in response to the detection of a first predetermined engine speed when the monitored fluid temperature is equal to or less than a predetermined value.

14. A valve operation system for an internal combustion engine having a cylinder and fuel supply means and intake and exhaust valves operatively associated with said cylinder and a valve operation mode changing mechanism for operating intake or exhaust valves in a low-speed mode or a high-speed mode dependent on the pressure level of engine oil applied to said mechanism, a control valve operatively disposed between said mechanism and a source of engine oil for varying the level of hydraulic pressure supplied to said mechanism, and control means for controlling the operation of said control valve, said system comprising:

a temperature detector for sensing engine coolant temperature which represents the temperature of said engine oil in said mode changing mechanism and for imparting to said control means a signal commensurate with the detected temperature;

and engine speed detector for monitoring the speed of said engine and for imparting to said control means a signal commensurate with the detected engine speed;

said control means including means for operating said control vale to impart to said mode changing mechanism an engine oil pressure effective to change said intake or exhaust valve operating mode from a low-speed mode in response to the detection of a predetermined engine speed only when the temperature detected by said temperature detector is equal to or exceeds a predetermined value.

* * * * *